US006564964B2

(12) United States Patent
Johnson

(10) Patent No.: US 6,564,964 B2
(45) Date of Patent: May 20, 2003

(54) APPARATUS FOR DISPENSING ITEMS FROM A VENDING MACHINE

(76) Inventor: David K. Johnson, HC 4, Box 357, McGregor, MN (US) 55760

( * ) Notice: Subject to any disclaimer, the term of this patent is extended or adjusted under 35 U.S.C. 154(b) by 0 days.

(21) Appl. No.: 10/235,629

(22) Filed: Sep. 4, 2002

(65) Prior Publication Data

US 2003/0006241 A1 Jan. 9, 2003

Related U.S. Application Data

(63) Continuation-in-part of application No. 09/735,194, filed on Dec. 8, 2000, now abandoned, which is a continuation-in-part of application No. 09/118,761, filed on Jul. 18, 1998, now abandoned.

(60) Provisional application No. 60/054,117, filed on Jul. 29, 1997.

(51) Int. Cl.[7] ..... G07F 11/36

(52) U.S. Cl. ..... 221/75; 221/129

(58) Field of Search ..... 221/74, 75, 88, 221/126, 129, 130, 131, 195, 123

(56) References Cited

U.S. PATENT DOCUMENTS 4,240,563 A * 12/1980 Lennartson ..... 221/75
4,560,088 A * 12/1985 Tan ..... 221/75
4,582,014 A * 4/1986 Patel ..... 114/125

* cited by examiner

*Primary Examiner*—Patrick H. Mackey
(74) *Attorney, Agent, or Firm*—Janet Peyton Schafer

(57) ABSTRACT

A coordinate selectable vending machine assembly for dispensing articles from a plurality of article storage compartments, including horizontally arranged helical coils, comprises a single dispenser, movable between the plurality of storage compartments for vending a selected article. The single dispenser is movable between the plurality storage compartments in response to an electronic signal sent by a micro control panel after a user has inserted money into the machine and used the coordinate section to identify the type of article to be dispensed. The dispenser moves, utilizing a pair of stepping motors, until aligned with the selected storage compartment. Once in position, the dispenser is urged from a normal position out of engagement with the storage compartment to a second position in engagement with the storage compartment for actuation of the vending selected article, which it then actuates resulting in dispensing of the article.

8 Claims, 7 Drawing Sheets

APPARATUS FOR DISPENSING ITEMS FROM A VENDING MACHINE

This application is a continuation in part application of Ser. No. 09/735,194, filed Dec. 8, 2000 now abandoned which is a continuation of part of application Ser. No. 09/118,761 filed Jul. 18, 1998 abandoned under under 35 U.S.C. §111(a), which replaced the provisional application, Ser. No. 60/054,117 filed Jul. 29, 1997 under 35 U.S.C. §111(b). Applicant claims benefit of the earlier filing date under 35 U.S.C. §120.

BACKGROUND

This invention relates generally to the field of dispensing apparatuses and specifically to vending machines of the type for dispensing food or other articles.

Prior art vending machines have used helical coils as an article storage device. In each of these prior vending machines, each helical coil required an individual vend motor. Because of the great numbers of vend motors required in these prior art vending machines, low cost motors were used to keep the vending machines economical to produce. These low cost motors frequently needed repair or replacement. Repair of these machines has been found to be costly and dangerous due to the great number of electrical circuits encountered because of the large numbers of motors, and because the machinery is generally accessible only from the rear.

Other prior arts have employed use of an X-Y support system that employs an unstable T-shaped apparatus with a pusher type dispenser and requires either an electrical brake, solenoid or positive brake motor that stops the motor shaft mechanically. This prior art vending device utilized sensors to determine position of the dispenser and mechanical brakes to halt the dispenser at the selected position While these units may be suitable for the particular purpose to which they address, they would not be as suitable for the purposes of the present invention as hereinafter described.

A vending machine using a single vend motor to engage and drive one of a plurality of helical coils, or other vend dispensing systems, would be an improvement. Additionally, a single vend motor mounted on a dispenser which has easy access for repair, would be a further improvement. Because only one vend motor is required, a higher quality motor, presumably needing less frequent repair, is used without compromising economical production, and would be an additional improvement. Additionally, providing a back-up vend motor within the vending machine that is easily powered by a switch to quickly replace a faulty vend motor, would provide a further improvement. Additionally, providing an I-shaped dispenser improves the stability of the dispenser during movement enabling faster movement of the dispenser to the selected position. Use of stepping motors to provide motive means along the X and Y axises simplifies the system in that the stepping motors are pre-programmed to move to a certain position in response to specific selected alpha numeric keys. Because the dispenser moves back to a "home" position immediately after each vend, the alpha numeric keys send the dispenser to the selected helical coil, or other storage device, consistently. Additionally, providing a dispenser that uses no mechanical brake but rather utilizes a stepping motor simplifies the system and makes it more economical both to manufacture and to repair.

SUMMARY

The present invention is directed to a vending machine that satisfies these needs for a vending machine that is economical to produce and operate and is easy to repair when repair is needed. Such a vending machine having features of the present invention comprises a coordinate selectable vending machine having a cabinet, a plurality of helical coils or other article support means, a dispenser having a single vend motor and a generally I-shaped support. Once in position adjacent the selected article storage mechanism, means for docking the dispenser with the selected article storage mechanism are provided. A single vend motor, mounted on the dispenser, actuates the selected vend dispensing system for driving engagement of the selected article storage mechanism dispensing the selected article. A plurality of helical coils or shelves are positioned generally horizontally within the cabinet as supporting means for receiving articles to be dispensed. An easily accessible single vend motor, mounted for movement on a dispenser within said cabinet, is provided for actuating a pre-determined helical coil to dispenser an article. Means are provided for moving the vend motor carrying dispenser to a position adjacent a selected helical coil. A vend motor, mounted on said dispenser, actuates the selected vend dispensing system for driving engagement of the selected article storage mechanism dispensing the selected article. Actuation means actuates each stepping motor moving the vend motor carrying dispenser to a predetermined position. Once in position, additional actuation means actuates the vend motor of the dispenser that in turn rotate the selected helical coil dispensing the article.

A solenoid urges the dispenser from a first, out-of-the-way position to a second, engaged, position in contact with a selected vend dispensing system such that actuation of the dispenser engages and actuates the selected vend dispensing system for dispensing the selected article. A conveyor carries the dispensed article to a bin for collection by the purchaser.

A coordinate selectable vending machine having a cabinet, an LED and a storage system having a plurality of article storage mechanisms, a single dispenser mounted for movement in an X-Y axis within the vending machine, and means for actuating a selected article storage mechanism for vending the selected article. Means are provided for moving the dispenser to a position adjacent the selected article storage mechanism as indicated by the micro control panel. A pair of stepping motors, which need no mechanical brakes, are utilized as means for moving the vend motor carrying dispenser mounted for movement on a generally I-shaped support. This I-shaped support moves along a horizontal track along the bottom of the vending machine. The I-shaped support is also supported and stabilized at a proximal end by a horizontal bar. The vend motor, mounted on the dispenser, is moved in response to electronic signals from a micro control panel. Once in position, a solenoid urges the vend motor, mounted on the dispenser, into engagement with the selected helical coil and the helical coil is rotated resulting in vending of the selected article. Movement of the dispenser is directed by the micro control panel.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but non-limiting example.

The present invention relates to a cabinet type coordinate selectable vending machine which is disclosed having a single dispenser, with a single vend motor drive attached, for selecting from a plurality of items to be dispensed. A primary dispenser moves to a vending site rather than having a vend motor for each vending site.

In this device, a generally I-shaped support carries the dispenser having a single vend motor mounted thereon. The I-shaped support is in turn carried by a track positioned horizontally below the I-shaped support within the vending machine. The I-shaped support is also supported and stabilized by a horizontal bar positioned above the I-shaped support. Upon receipt of electrical signals, the dispenser is moved horizontally along the track and then vertically by a pulley system to a selected position whereupon the vend motor mounted on the dispenser is moved into engagement with the selected helical coil. A vend motor engages an end of the selected helical coil or other article storage means, and rotates the helical coil, vending the selected article.

Figure 1:
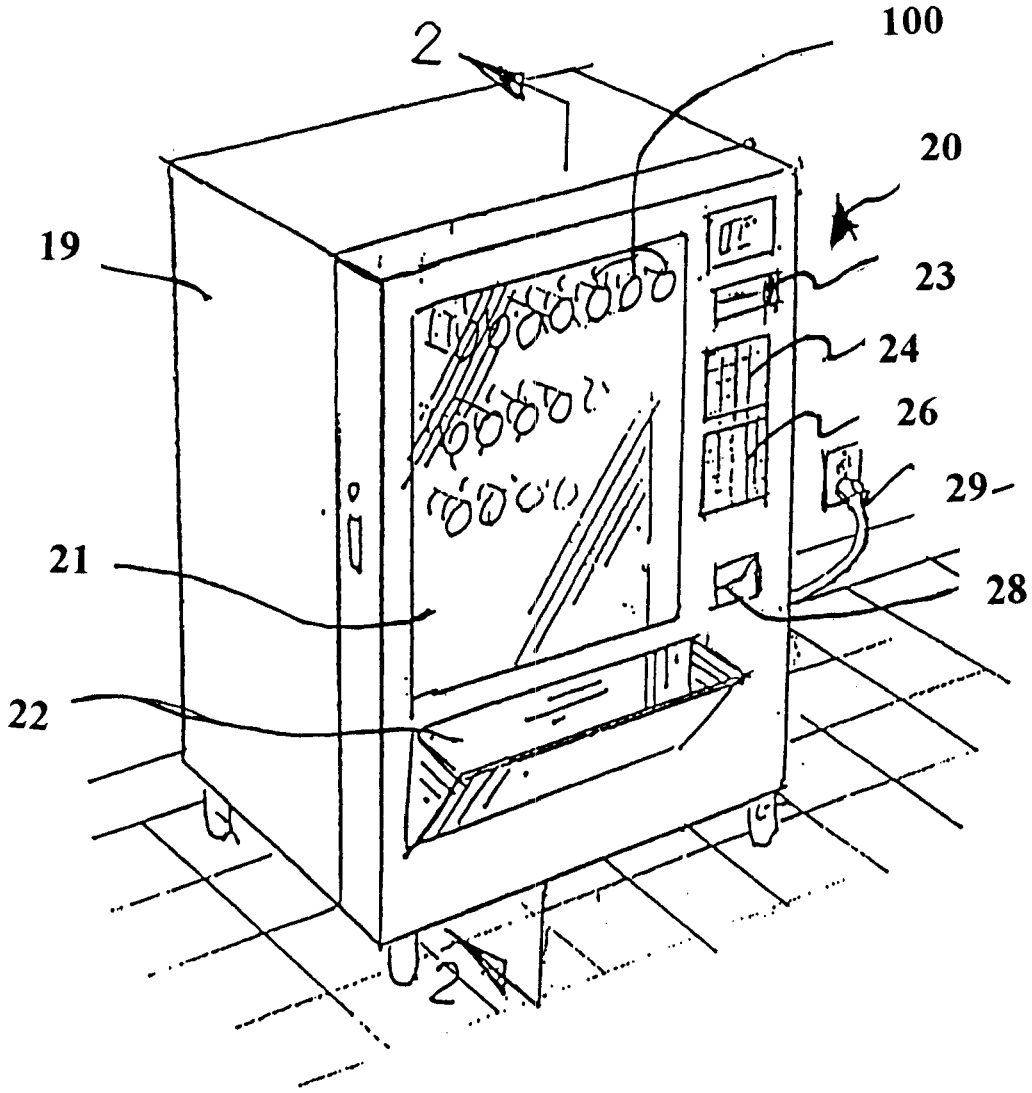
FIG. 1 is a perspective view of a typical coordinate selectable vending machine.

Turning now to the drawings, in which like reference characters refer to corresponding elements throughout the several views, FIG. 1 illustrates a typical coordinate selectable vending machine 20. The vending machine 20 has a cabinet 19 with a clear panel 21 through which a user may see the items for purchase suspended by a series of helical coils 100, or other vending shelf arrangement. By inserting money into the money receptacle 23 and selecting the item by identifying the item by means of the alphabetic keyboard 24 and the numeric keyboard 26, the vending machine 20 dispenses the selected item into a trough 22 for access by the machine user. A coin return is indicated at 28. The vending machine 20 is powered by means of an electrical cord 29.

The present invention utilizes a plurality of helical coils with one dispenser 210. The dispenser 210 moves and the helical coils 100 are stationary until actuated. The dispenser 210 goes up or down until aligned with appropriate helical coil 100 which it then actuates by receiving an end of the helical coil 100 resulting in dispensing of the article. Dispenser 210 moves up or down until aligned with the appropriate helical coil 100 which it then actuates by rotating arm 210 360 degrees which rotates helical coil 100.

Figure 2:
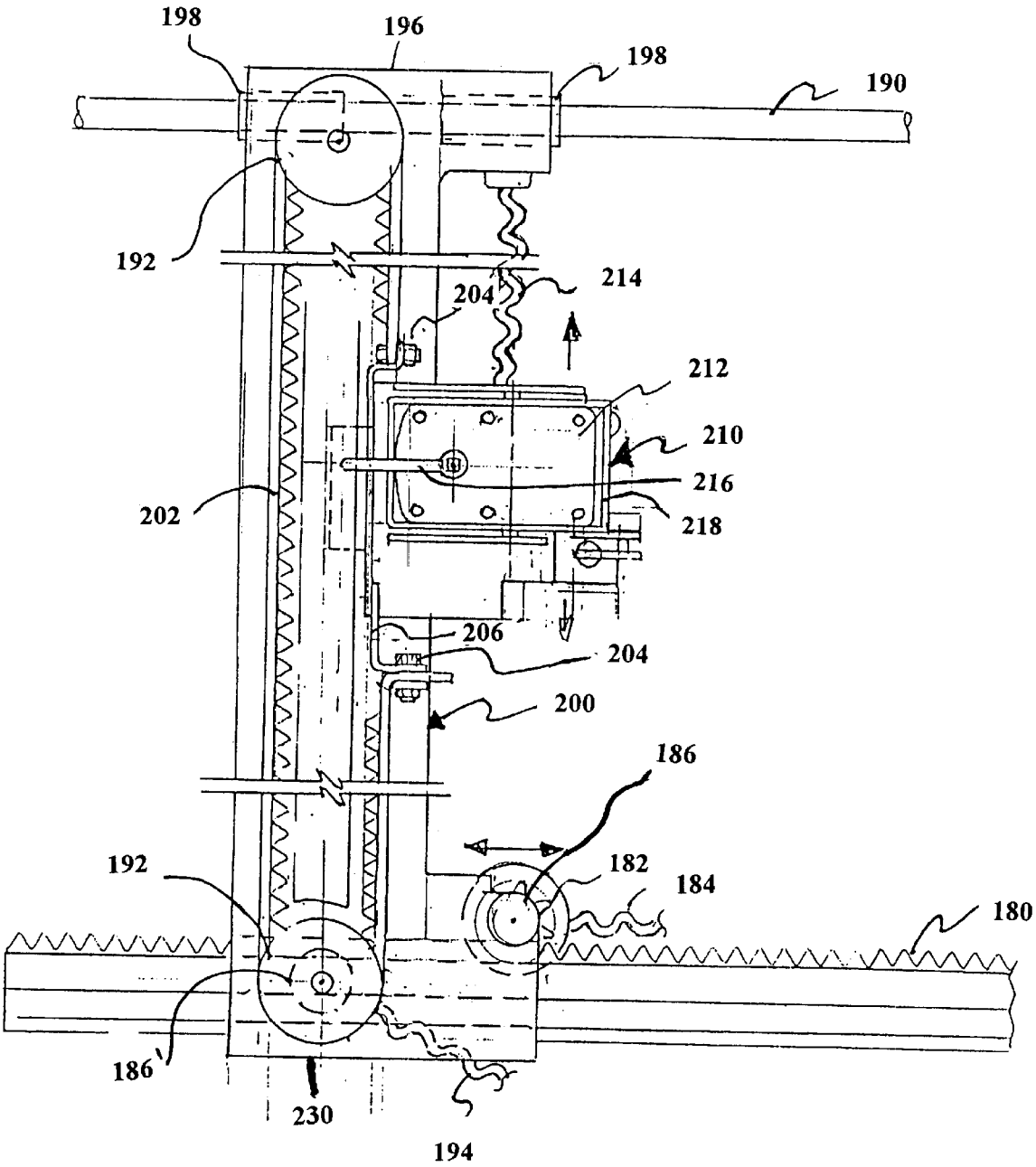
FIG. 2 is a simplified internal view of the coordinate selectable vending machine of the present invention.

FIG. 2 is a simplified internal view of the first embodiment vending machine 20 of the current invention with parts removed for ease of understanding. Dispenser 210 has mounted thereon a single vend motor 212, in actual use conditions a Model # 2593 24 volt electric motor, made by Molin, Inc., Chicago, Ill., has been used although any motor which produces sufficient power to rotate a helical coil 100 carrying a vend article in a weight range between a few ounces to a pound, could be used. A back-up dispenser vend motor can be stored within the cabinet. A conventional electronic coin changer money receptacle 23 and multi-pricing unit LED 110 is provided to actuate the dispenser 210. In actual use conditions, a model 9302 LED, as made by Coinco, of St. Louis, Mo., has been used although any logic-type LED could be used. This LED has a transformer that transforms the electrical power from 110 volts to 24 volts DC. This reduction in electrical circuit enables contact to be made with the circuitry without a dangerous electrical charge being received by the repair person. This is an important innovation.

Dispenser 210 moves horizontally in the X axis, indicated by arrows.

Figure 5:
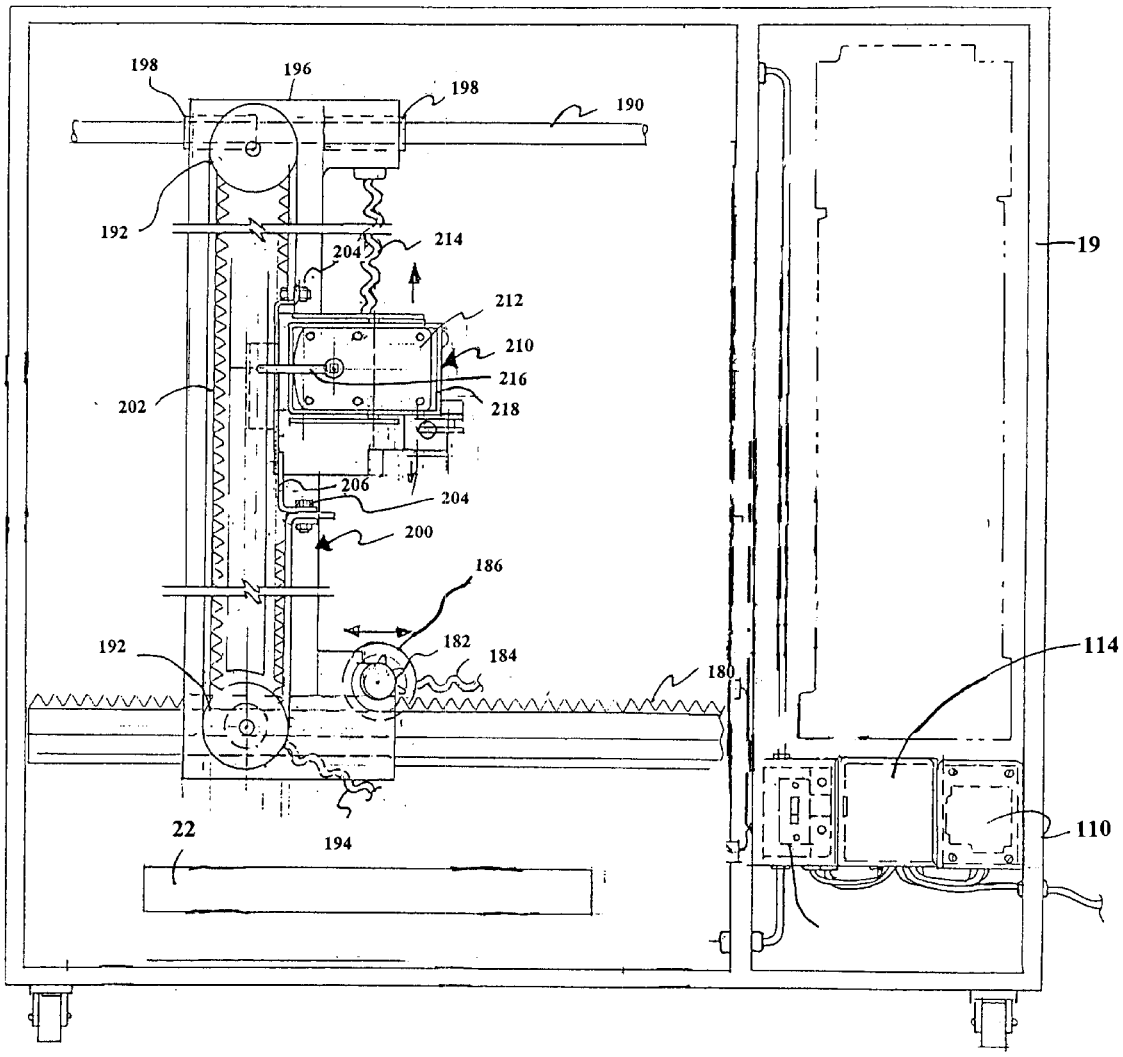
FIG. 5 is a simplified internal view of the device of the present invention.
Figure 6:
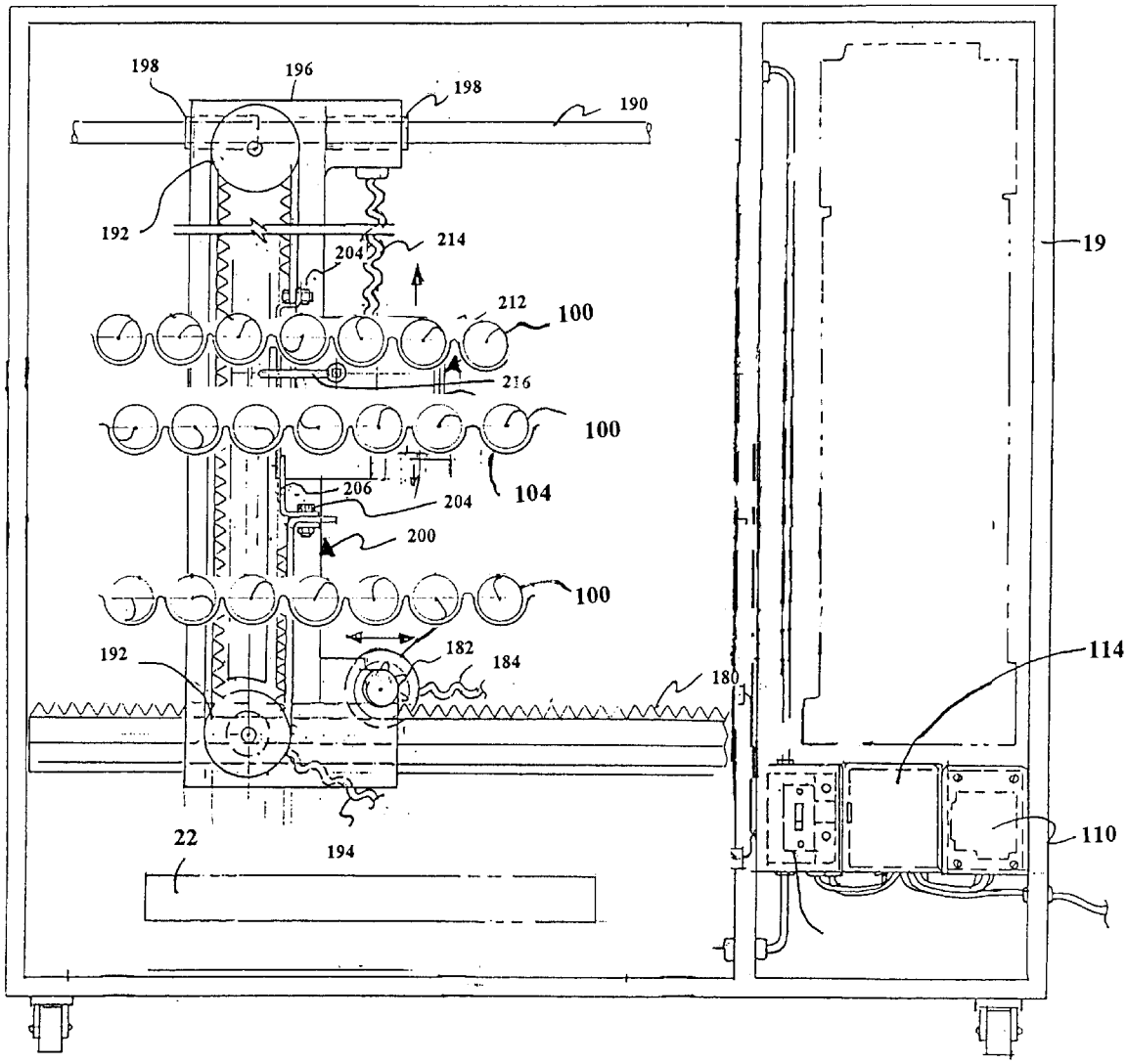
FIG. 6 is a simplified internal view of the device of the present invention with helical coils shown.

Micro control panel 114, as shown in FIGS. 5 & 6, consists of a circuit board having a computer chip therein. This programmable micro control panel is programmed to move the dispenser 210 by means of a pair of stepping motors to a selected position, the position selected by use of the alpha and numeric keyboards. Because the dispenser 210 returns to "home position" each time after dispensing an article, selection of an item by the user pushing the alpha and numeric keys causes the dispenser 210 to move to predetermined path in an X and Y axis. The micro control panel 114 interfaces between the LED 110 and vend motor 212 on dispenser 210.

Vending machine shown in detail at FIGS. 2, 5,& 6, utilizes a dispenser 210 with a single vend motor 212 for vending any article from any horizontal shelf withing the vending machine 20. In this embodiment, the dispenser 210 is moved along an X-Y axis by an I-shaped support 200. Support 200 moves horizontally along a horizontal toothed track 180 or power rail. Sprocket 182, such as one made by Inch Drive Corp., rotationally mounted on support 200, drives dispenser 210 as it moves along horizontal toothed track 180 in response to electrical signals from first stepping motor 186, supplied by means of electric cord 184. In actual use, a toothed track made by Lightning Corporation is used although other track means could be utilized. Because dispenser 210 is a follower of support 200, dispenser 210 moves horizontally with support 200.

Flexible toothed band 202, such as a timing belt, made by Inch Drive components, is mounted for movement on support 200 and provides vertical movement to support 200 and to the follower dispenser 210. Belt pulley 192, powered by electrical cord 194, drives flexible toothed band 202 with dispenser 210. Belt pulley 192, powered by a second stepping motor 186', drives flexible toothed band 202, with dispenser 210, along a vertical plane in response to electrical signals received from micro control panel 114.

Horizontal bar 190 acts as a stabilizer bar and prevents I-shaped support 200 from twisting or otherwise coming out of alignment with horizontal toothed track 180. A proximal end of support 196 is mounted by bushings 198 onto horizontal bar 190 allowing support 200 to move horizontally yet stabilizing support 200. A distal end 230 of dispenser 210 is driven along horizontal toothed track 180 by a first stepping motor 186 driving a gear sprocket 182 along the horizontal toothed track 180. Having a generally I-shape to dispenser 210 increases stability during movement, because dispenser 210 is attached at both ends, while remaining a simple solution.

As shown in FIG. 2, vend motor 212, mounted on dispenser 210, is powered by electric cord 214 in response to electrical signals received by electronic control board 114. Dispenser 210 is mounted to flexible toothed band 202 by fastening means such as a nut and bolt 204, through an aperture formed in support flange 206, although other fastening means could be used. In this embodiment, vend motor 212 has mounted thereon an arm 216 that rotates 360° when in position to engage a selected helical coil 100 or other vending shelf arrangement, causing the selected article to be vended or dropped into trough 22.

Stepping motors 186, 186' are used to power both gear 182 and a to power belt pulley 192. In actual use conditions, a Power Max II stepping motor as made by Pacific Scientific Co., has been used although other similar motors could be used. This is the preferred embodiment because the stepping motor, which "punches" the dispenser 210 into position, is faster, cheaper, and less complicated than any system. Additionally, the lifetime expectancy of the stepping motor is longer. The use of stepping motors 186, 186' eliminates the need for any mechanical brake because stepping motors are either "on" or "not on", "powered" or "not powered".

Figure 3:
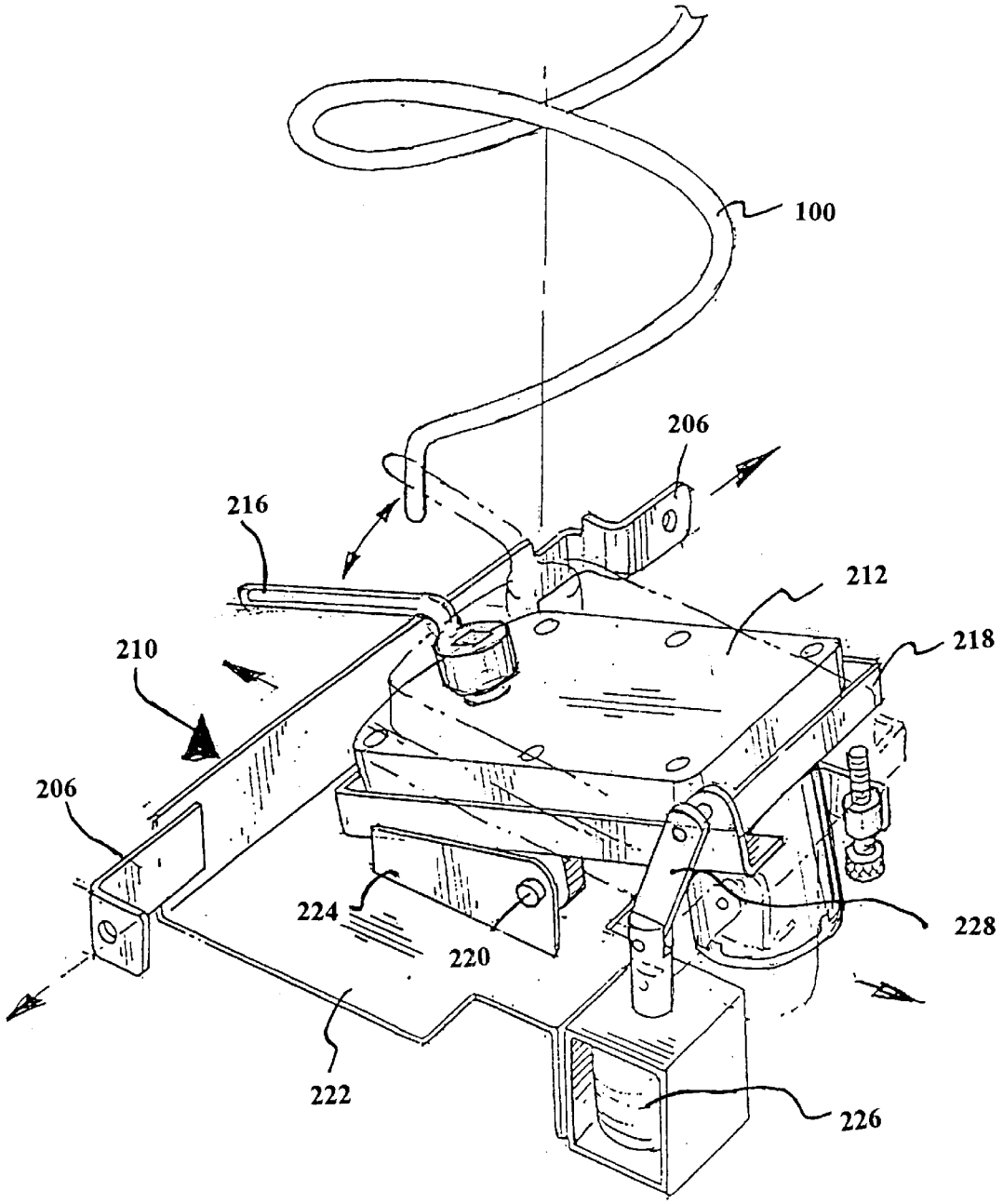
FIG. 3 is a perspective view of the motorized dispenser positioned for movement between helical coils with the engagement position shown in phantom.
Figure 4:
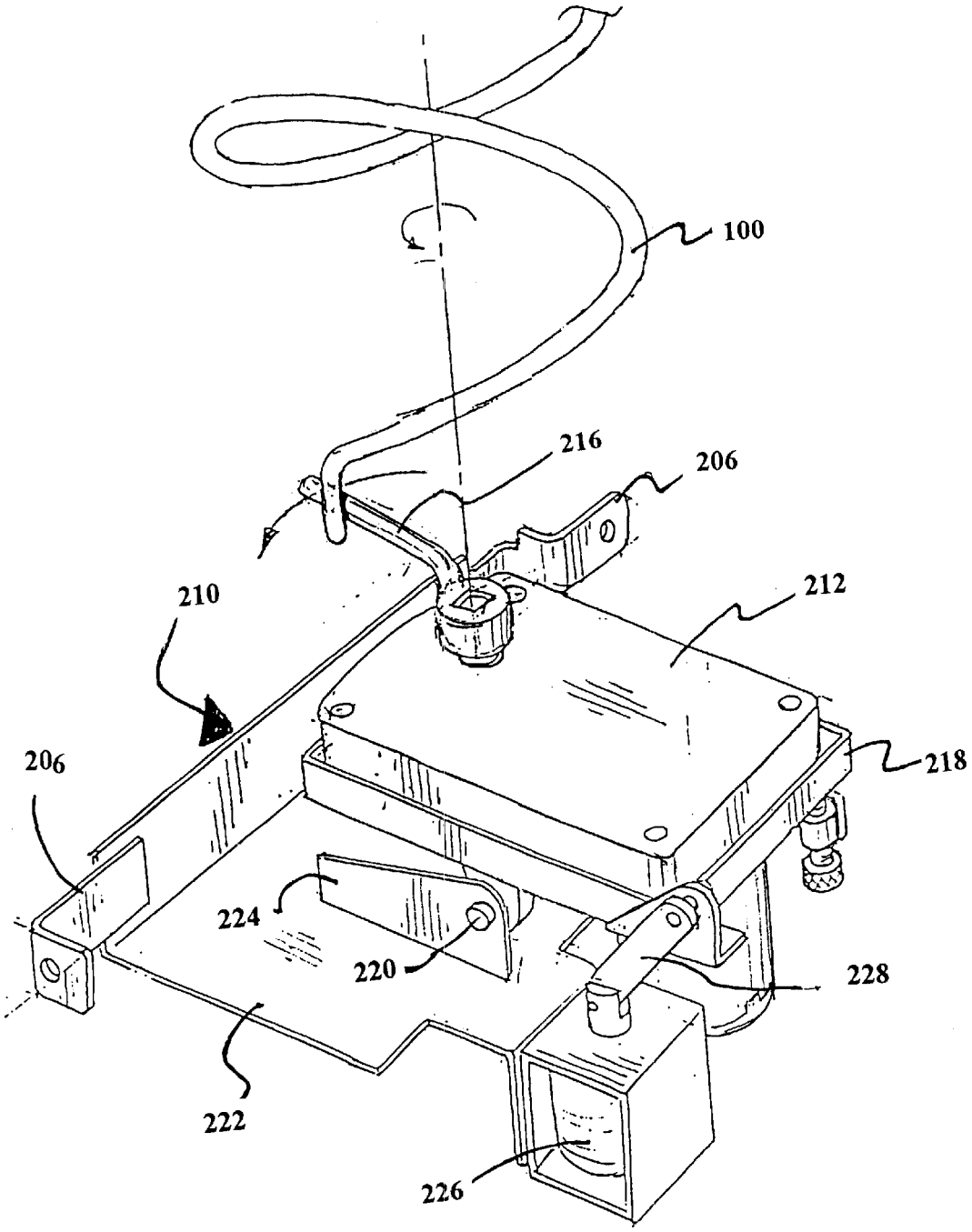
FIG. 4 is a perspective view of the motorized dispenser in engagement with the helical coil, with motion of both the actuated vend motor arm and the helical coil indicated.

Engagement of dispenser 210 to the selected helical coil 100 is described and shown in FIG. 3 & 4. In FIG. 4, Dispenser 210 is shown in its position of use in contact with and for powering helical coil 100. In FIG. 3, dispenser 210 is shown in its out-of-way position disengaged from helical coil 100 with the in position of use shown in phantom.

Once a selected helical coil 100 is actuated by vend motor 212 carried by dispenser 210, helical coil 100 makes a 360 degree rotation. Each signal from micro control panel 114 results in stepping motors 186,186' being actuated which in turn actuates micro switch 74, FIG. 7, powering eventual rotation of arm 216. A link arm 228 mounted on dispenser 210 provides an attachment that moves dispenser 210 either into engagement with helical coil 100, as shown in FIG. 4, or out of the engagement with helical coil 100, as shown in FIG. 3, either pulling or pushing dispenser 210 in response to movement of solenoid 226.

Pivoting member 218 is mounted to dispenser 210 by screws, although rivets, welds, etc. and other fasteners, could be used to enable the dispenser 210 to be urged to an out of the way position out of engagement with any helical coil to a position in a range of 5–15 degrees from engagement, although 10–12 degrees has been found to work well, and re-positioned to a next-selected helical coil 100.

As shown in FIG. 4, vend motor 212 is mounted to dispenser 210 by pivoting member 218 that is further attached by mounting means such as screws to dispenser plate 222. Pivoting member 218 pivots around a pair of pins 200 mounted on fins 224 on dispenser plate 222. Pivoting member 218 pivots vend motor 212 in response to a solenoid 226 from a first position, out of the way of the helical coils 100 shown at FIG. 3 to a second position in engagement with helical coil 100, shown in phantom in FIG. 4. Movement of arm 216 is indicated in FIG. 4 with corresponding, following movement of helical coil 100.

Solenoid 226, FIGS. 3 & 4, is in electrical communication with dispenser 210, so that, when solenoid 226 is actuated, it engages dispenser 210, pushing vend motor arm 216 to the pre-selected helical coil 100 in turn actuating helical coil 100 to vend the selected article stored thereupon.

Figure 7:
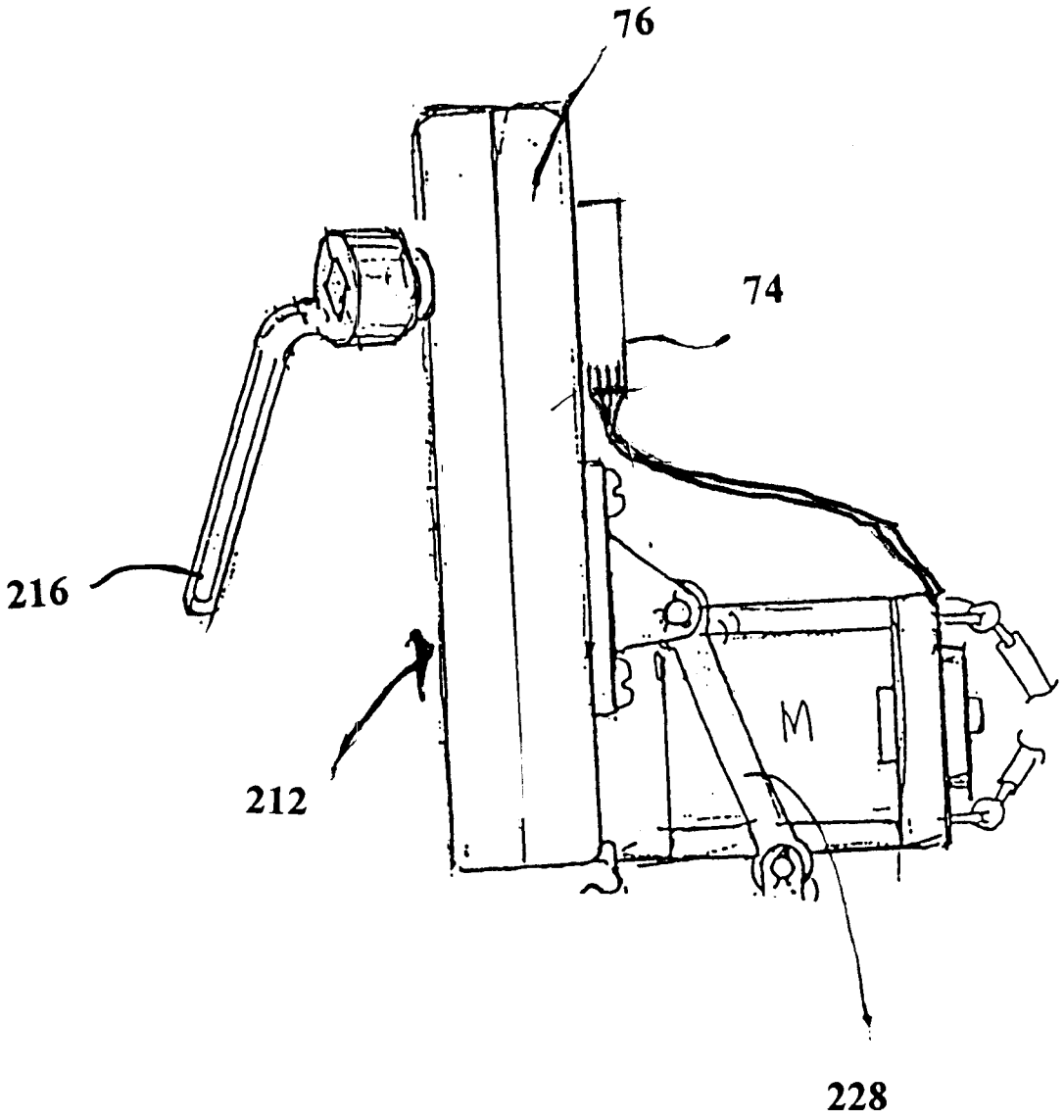
FIG. 7 is a side view of the vend motor with micro switch of the present invention.

Circuitry between LED 110 and micro control panel 114, FIGS. 5 & 6, in actual use conditions is 26 gauge wire although other gauge wires could be used so long as they can carry the load without endangering the repair person. The circuitry is held in place by a harness, not shown, which prevents the vend motor from becoming entangled in the circuitry. FIG. 5 shows the I-shaped dispenser 210 in its position of use within the vending machine cabinet 19 with micro control panel 114 and LED 110 also shown within the cabinet. FIG. 6 is included to show generally placement of the I-shaped dispenser 210 in relationship to the helical coils 100. FIG. 7 is a close-up view of the vend motor 212 with it's gear box 76, arm 216, actuated by micro switch 74.

When repair is necessary, easy access to replace dispenser 210 is made by pulling out a helical coil shelf 104 and simply manually plugging in the new dispenser 210 as compared to existing vending machines which require the back of the vending machine to be removed and a variety of tools to accomplish repair. Being able to access the dispenser 210 mount from the front is a distinct advantage. Also, being able to pull out the damaged dispenser 210 and replacing it by plugging in a new motor is a distinct advantage.

Simple installation of the dispenser 210 is a further object of this invention. Additionally, because a single vend motor is required rather than a dozen or more conventionally 210 or 60 or more vend motors, a single vend motor in a dispenser 210 of the current application, or at most, two with the back-up dispenser, vend motors of higher quality maybe economically used.

It is an object of the invention to provide a power source which uses a small amount of electrical power such that contact by the repair person with the electrical circuits does not pose a hazard to the repair person. This invention could also be retro-fit into an existing vending machine.

It is an advantage of the present invention in that they use only one vend motor mounted on a dispenser. The device has a second dispenser with a second vend motor as a back-up. In either case, manufacture of the vending machine of the present invention is more economic to make. Additionally, because the dispenser 210 is mounted on an easily accessible position, no tools are required to install a new dispenser 210.

Dispenser 210 is mounted to an I-shaped support 200 for movement. Movement in the Y axis is accomplished by means of a flexible toothed band 202 to which dispenser 210 is mounted. In actual use conditions, a toothed band as made by Inch Drive Components, specifically a precision rack fine pitch band having a brass or plastic toothed band, has been utilized although other bands could be used. Flexible toothed band 202 is moved by belt pulley 192. Belt pulley r 192 is powered by stepping motor 186. Cord 194 brings power to stepping motor 186.

Dispenser 210 is moved in an X or horizontal plane by gear 182 powered by stepping motor 186. Electrical cord 184 brings power to this stepping motor 182.

I-shaped dispenser support 200 is in turn supported by horizontal bar 190. Proximal end 196 of I-shaped support receives horizontal bar 190. Bushings 198 provide ease of movement of I-shaped support 200 horizontally along horizontal bar 190.

Dispenser 210 is attached by attachment means, here nuts and bolts 204 at support flange 206 of dispenser 210. Vend motor 212 is mounted for movement and is a follower of dispenser 210. Power cord 214 powers vend motor 212. Arm 216, shown in detail in FIGS. 3, 4 and 7, rotates 360 degrees in response to signals received from controller board. Stepping motors 186, 186", provide motive power to dispenser 210 in response to signals received from micro control panel 114. Stepping motors in general have no mechanical brakes. Rather, they are either powered or not powered; move or don't move. In response to a signal, they move a predetermined distance. One signal results in this movement. When the signal stops, the stepper motor moves it's prescribed distance and stops. The conventional definition of brakes is: a device for slowing or stopping a vehicle or other moving mechanism by the absorption or transfer of energy of momentum, usually by means of friction. In a stepping motor, no device absorbs transfer of energy or friction. In this sense, stepping motors are brake-free.

In the instant application, a micro control panel 114, in electrical connection between the LED and the stepping motor, runs the stepping motors 186, 186' and directs their movement. A stepping motor in general "counts" electrical impulses and moves a pre-determined distance in response. Stepping motors have a holding torque to hold them in place. One cannot accelerate stepping motors; the stepping motor is either "on" or "not on". Micro switch 74, when electrically stimulated by micro control panel, comes "open" and vend arm 216 travels 360 degrees. Then micro switch 74 "closes" electronically. Micro switch 74 stays closed until another signal from micro control panel 114. Micro control panel 114 signals dispenser 210 to move to the selected position then signals the dispenser mounted micro switch 74 to vend.

FIG. 3 illustrates the motorized dispenser 210 in its rest position, positioned for movement of the dispenser 210 between helical coils 100 without engaging these coils. The engagement position shown in phantom. FIG. 4 shows the motorized dispenser 210 in engagement with the helical coil 100, with motion of both the actuated vend motor arm and the helical coil indicated Once the dispenser 210 with the follower vend motor 212 is in position, solenoid 226 pushes vend motor 212 carrying pivoting member or dispenser 210 outwardly such that arm 216 comes into engagement with the end of helical coil 100. Rotation of arm 216 in response to vend motor 212 actuation rotates helical coil 100 resulting in turning of the helical coil 360 degrees where the selected article is dispensed. Fins 224, mounted on dispenser plate 222 attach pivoting member 218 by means of pins 220 or other fastening means.

In use, in response to money being put into the vending machine at receptor 23, the LED 110 sends a message to the micro control panel 114 regarding which selection has been made. The micro control panel 114, which actuates, by means of conventional circuitry, the dispenser 210 to move to the desired location. Electronic signals from a controller circuit board denote the distance the dispenser 210 is to move both in an X and Y axis. Dispenser 210, mounted on the I-shaped support 200 for both vertical and horizontal movement, moves horizontally on horizontal toothed track 180. Because a stepper motor is used, no mechanical brakes are required to aid in the positioning of dispenser 210 at the selected helical coil 100. The horizontally positioned rod 190 is mounted to stabilize dispenser 210. Vertical movement of dispenser 210, and follower vend motor 212 is accomplished by gear sprocket 182 driving flexible toothed band 180 with carrier dispenser 210 and associated vend motor 212. Dispenser 210 operates at this location to vend the desired article. After the push button is pushed on a selector panels 24,26, by the customer, a momentary pause occurs allowing powering up of and re-location of the dispenser 210. In actual use conditions, vending of the selected article takes place approximately five (5) seconds after deposit of money into the LED change box. After vending an article, dispenser 210 returns to a rest position.

Because a normal vend motor operating at 16–21 rpm at 24 volts, a normal motor, makes about 40,000 cycles or vends in a lifetime. With an average cycles/per day in a snack machine at 50 cycles, resulting in about 18,000 cycles per year. The average motor lasts over two years in either embodiment of this invention. Having one vend motor/per machine greatly reduces the cost of the machine. Having three wires as electrical connection rather than a multiplicity of wires, more than 70 in a typical vending machine, greatly enhances both the safety and the ease of manufacture and operation of the vending machine.

It is understood that although helical coils are shown as the vending shelf in these figures, other means of holding articles are included and adaptable for use with this invention. It is further understood that the single vend motor dispenser system, along with the means for moving the dispenser could be retro-fit into existing vending machines. This would be especially easy with vending machines using helical coils.

When the vending machine is in use, in response to money being put into the vending machine at receptor 23, shown in FIG. 1, the LED 110 sends a message to the micro control panel 114 regarding which selection has been made. The micro control panel 114, actuates by means of conventional circuitry the dispenser 210. Dispenser 210, after the push button is pushed on a selector panels 24,26, by the customer, a momentary pause occurs allowing powering up of and re-location of the dispenser 210. In actual use conditions, vending of the selected article takes place approximately five (5) seconds after deposit of money into the LED change box. After vending an article, dispenser 210 returns to a centrally located rest position.

Although the present invention has been described in considerable detail with reference to certain preferred versions thereof, other versions are possible. Therefore, the spirit and scope of the appended claims should not be limited to the description of the preferred versions contained herein.

What is claimed is:

1. A coordinate selectable vending machine, having a cabinet, a series of article storage devices for holding articles to be vended mounted generally horizontally therein, a coin sensing unit, for selectively dispensing articles, comprising:

a) a single dispenser mounted for horizontal and vertical movement within the vending machine such that only one dispenser is needed for operating any of a series of article storage devices;

b) a single vend motor, such that only one vend motor is needed for dispensing any of a series of articles, mounted to said dispenser;

c) an I-shaped dispenser support for receiving said dispenser;

d) means for moving said dispenser along substantially X Y axises into engagement with a selected article storage devices;

e) programmable actuation means for movement of said dispenser to a selected position;

f) means for actuating said vend motor, once said dispenser is in position, for vending the selected article; and g) a solenoid for urging said vend motor into engagement with selected as one of a series of article storage devices in response to signals from a micro control panel.

2. The vending machine of claim 1, wherein said I-shaped dispenser support further comprises a proximal end, mounted for horizontal movement to a stabilizer bar, and a distal end mounted to horizontal toothed track as horizontal motive means.

3. The vending machine of claim 1, wherein said means for moving said dispenser along substantially X Y axises further comprise a pair of stepping motors a first stepping motor for powering said dispenser support in a horizontal, or X, axis and a second stepping motor for powering said dispenser support in a vertical, or Y, axis.

4. The vending machine of claim 1, wherein said programmable actuation means for movement of said dispenser to a selected position further comprises a micro control panel that directs each stepping motor to drive said dispenser to a selected position.

5. The vending machine of claim 1, wherein said means for actuating said vend motor once in position for vending the selected article further comprise a micro switch which drives an arm of said vend motor 360 degrees in response to an electric signal from said micro control panel.

6. A coordinate selectable vending machine, having a cabinet, a series of article storage devices for holding articles to be vended mounted generally horizontally therein, a coin sensing unit, for selectively dispensing articles, comprising:

a) a single dispenser mounted for horizontal and vertical movement within the vending machine such that only one dispenser is needed for operating any of a series of article storage devices;

b) a single vend motor, such that only one vend motor is needed for dispensing any of a series of articles, mounted to said dispenser;

c) an I-shaped dispenser support for receiving said dispenser, having a vend motor mounted thereto and a follower thereof, wherein motive means of said dispenser along an X axis is a gear sprocket for driving said dispenser along a horizontal toothed track in response to activation of a first stepping motor, and motive means of said dispenser along a Y axis is a belt pulley pulling said dispenser along a flexible toothed band in response to activation of a second stepping motor;

d) programmable actuation means for movement of said dispenser to a selected position by directing movement of both first and second stepping motors in a preselected manner in response to alpha and numeric keyboards of coordinate selection; and e) means for actuating said vend motor, once said dispenser is in position, for vending the selected article.

7. The vending machine of claim 6, further comprising a solenoid for urging said vend motor into engagement with selected helical coil, the coil rotating in response to rotation of a vend motor pivoting arm rotating in response to signals from the micro control panel.

8. A vending machine, having a cabinet, and a series of helical coils for holding articles to be vended mounted generally horizontally therein for selectively dispensing articles, comprising:

a) a dispenser needing no mechanical brakes, having a single vend motor mounted thereon, said dispenser mounted for movement along generally X-Y axises within the vending machine;

b) an I-shaped dispenser support means for moving said dispenser along generally X-Y axises into engagement with a selected helical coil for dispensing a selected article;

c) a horizontal track for receiving said dispenser, adapted for horizontal movement along said horizontal track in response to actuation means;

d) dispenser actuation means for actuating said dispenser mounted vend motor into engagement for rotation of a selected helical coil for dispensing a selected article;

e) a vertical track for guiding movement of said dispenser in response to belt pulley driven by a second actuation means;

f) a pair of stepping motors used for actuation means; and g) a solenoid for urging said vend motor into engagement with selected one of a series of article storage devices in response to signals from the micro control panel.

* * * * *